US007504965B1

(12) United States Patent
Windover et al.

(10) Patent No.: US 7,504,965 B1
(45) Date of Patent: Mar. 17, 2009

(54) PORTABLE COVERT LICENSE PLATE READER

(75) Inventors: Mark Edward Windover, Greensboro, NC (US); Bernard D. Howe, Browns Summit, NC (US)

(73) Assignee: Elsag North America, LLC, Greensboro, NC (US)

( * ) Notice: Subject to any disclaimer, the term of this patent is extended or adjusted under 35 U.S.C. 154(b) by 221 days.

(21) Appl. No.: 11/462,855

(22) Filed: Aug. 7, 2006

Related U.S. Application Data

(60) Provisional application No. 60/706,163, filed on Aug. 5, 2005.

(51) Int. Cl.
*G08G 1/017* (2006.01)

(52) U.S. Cl. ..... 340/937; 340/933; 382/105

(58) Field of Classification Search ..... 340/937, 340/933; 382/105; 348/164–168, 161
See application file for complete search history.

(56) References Cited

U.S. PATENT DOCUMENTS

| | | | |
|---|---|---|---|
| 3,590,151 | A | 6/1971 | Keith |
| 3,740,466 | A | 6/1973 | Marshall et al. |
| 3,781,468 | A | 12/1973 | Chomet et al. |
| 3,825,676 | A | 7/1974 | Ramsden, Jr. |
| 3,836,710 | A | 9/1974 | Takahashi |
| 3,851,096 | A | 11/1974 | Collins et al. |
| 4,148,062 | A | 4/1979 | Kamin |
| 4,185,298 | A | 1/1980 | Billet et al. |
| 4,257,063 | A | 3/1981 | Loughry et al. |
| 4,337,482 | A | 6/1982 | Coutta |
| 4,458,266 | A | 7/1984 | Mahoney |
| 4,511,886 | A | 4/1985 | Rodriguez |

(Continued)

FOREIGN PATENT DOCUMENTS

| | | | |
|---|---|---|---|
| BE | 1008083 | A | 1/1996 |
| CA | 1333635 | C | 12/1994 |
| CA | 2199999 | | 9/1998 |
| DE | 4401993 | A1 | 7/1995 |
| DE | 4443298 | A1 | 6/1996 |
| DE | 19544495 | A1 | 6/1997 |

(Continued)

OTHER PUBLICATIONS

Schwarzinger, Michael, et al., "Vision-Based Car-Following: Detection, Tracking, and Identification", pp. 24-29, Institut für Neuroinformatik, Ruhr-Universtät Bochum, Germany.

(Continued)

*Primary Examiner*—Daniel Wu
*Assistant Examiner*—Hongmin Fan
(74) *Attorney, Agent, or Firm*—Womble Carlyle Sandridge & Rice

(57) ABSTRACT

A surveillance system for covertly monitoring vehicle license plates. A portable covert license plate reader is provided for automatically reading license plate images for each of a plurality of moving vehicles that pass through a field of view of a camera in the reader without detection by the moving vehicles. A mobile surveillance unit is located in proximity to the license plate reader for receiving license plate character strings extracted by the reader, comparing each received image with a list of target plates of interest to law enforcement, and generating an audible alarm and a visual display when a match is found. An operations center is also provided for communicating with the mobile surveillance unit to receive license plate data from the mobile surveillance unit and to provide updates to the list of target plates stored at the mobile surveillance unit.

13 Claims, 8 Drawing Sheets

U.S. PATENT DOCUMENTS

| | | | | |
|---|---|---|---|---|
| 4,514,068 | A | 4/1985 | Urquhart | |
| 4,547,897 | A | 10/1985 | Peterson | |
| 4,567,609 | A | 1/1986 | Metcalf | |
| 4,591,823 | A | 5/1986 | Horvat | |
| 4,651,143 | A | 3/1987 | Yamanaka | |
| 4,679,077 | A | 7/1987 | Yuasa et al. | |
| 4,704,694 | A | 11/1987 | Czerniejewski | |
| 4,728,195 | A | 3/1988 | Silver | |
| 4,737,847 | A | 4/1988 | Araki et al. | |
| 4,772,945 | A | 9/1988 | Tagawa et al. | |
| 4,774,570 | A | 9/1988 | Araki | |
| 4,817,166 | A | 3/1989 | Gonzalez et al. | |
| 4,818,998 | A | 4/1989 | Apsell et al. | |
| 4,821,118 | A | 4/1989 | Lafreniere | |
| 4,876,597 | A | 10/1989 | Roy et al. | |
| 4,908,500 | A | 3/1990 | Baumberger | |
| 4,908,629 | A | 3/1990 | Apsell et al. | |
| 4,922,339 | A | 5/1990 | Stout et al. | |
| 4,962,463 | A | 10/1990 | Crossno et al. | |
| 4,972,359 | A | 11/1990 | Silver et al. | |
| 5,003,317 | A | 3/1991 | Gray et al. | |
| 5,023,714 | A | 6/1991 | Lemelson | |
| 5,034,817 | A | 7/1991 | Everett, Jr. | |
| 5,073,819 | A | 12/1991 | Gates et al. | |
| 5,091,780 | A | 2/1992 | Pomerleau | |
| 5,136,658 | A | 8/1992 | Mori | |
| 5,229,850 | A | 7/1993 | Toyoshima | |
| 5,253,070 | A | 10/1993 | Hong | |
| 5,263,118 | A | 11/1993 | Cornelison | |
| 5,272,527 | A | 12/1993 | Watanabe | |
| 5,274,714 | A | 12/1993 | Hutcheson et al. | |
| 5,278,563 | A | 1/1994 | Spiess | |
| 5,283,644 | A | 2/1994 | Maeno | |
| 5,289,369 | A | 2/1994 | Hirshberg | |
| 5,293,428 | A | 3/1994 | Kondou et al. | |
| 5,339,000 | A | 8/1994 | Bashan et al. | |
| 5,339,104 | A | 8/1994 | Hong | |
| 5,343,237 | A | 8/1994 | Morimoto | |
| 5,367,439 | A | 11/1994 | Mayer et al. | |
| 5,371,690 | A | 12/1994 | Engel et al. | |
| 5,381,155 | A | 1/1995 | Gerber | |
| 5,424,747 | A | 6/1995 | Chazelas et al. | |
| 5,425,108 | A | 6/1995 | Hwang et al. | |
| 5,426,509 | A | 6/1995 | Peplinski | |
| 5,465,308 | A | 11/1995 | Hutcheson et al. | |
| 5,471,239 | A | 11/1995 | Hill et al. | |
| 5,473,364 | A | 12/1995 | Burt | |
| 5,497,430 | A | 3/1996 | Sadovnik et al. | |
| 5,539,454 | A | 7/1996 | Williams | |
| 5,546,072 | A | 8/1996 | Creuseremee et al. | |
| 5,552,823 | A | 9/1996 | Kageyama | |
| 5,559,496 | A | 9/1996 | Dubats | |
| 5,568,406 | A | 10/1996 | Gerber | |
| 5,614,960 | A | 3/1997 | Chiba et al. | |
| 5,625,702 | A | 4/1997 | Kamada et al. | |
| 5,646,675 | A | 7/1997 | Copriviza et al. | |
| 5,651,075 | A | 7/1997 | Frazier et al. | |
| 5,657,008 | A | 8/1997 | Bantli | |
| 5,661,473 | A | 8/1997 | Paschal | |
| 5,712,679 | A | 1/1998 | Coles | |
| 5,731,785 | A | 3/1998 | Lemelson et al. | |
| 5,809,161 | A | 9/1998 | Auty et al. | |
| 5,831,669 | A | 11/1998 | Adrain | |
| 5,844,603 | A | 12/1998 | Ogata | |
| 5,845,268 | A | 12/1998 | Moore | |
| 5,852,528 | A | 12/1998 | Kori et al. | |
| 5,872,858 | A | 2/1999 | Kamada et al. | |
| 5,877,804 | A | 3/1999 | Otsuki et al. | |
| 5,917,423 | A | 6/1999 | Duvall | |
| 5,926,209 | A | 7/1999 | Glatt | |
| 5,938,717 | A | 8/1999 | Dunne et al. | |
| 5,948,038 | A | 9/1999 | Daly et al. | |
| 5,955,965 | A | 9/1999 | Calandruccio | |
| 5,963,129 | A | 10/1999 | Warner | |
| 6,037,880 | A | 3/2000 | Manion | |
| 6,046,774 | A | 4/2000 | Heo et al. | |
| 6,052,068 | A | 4/2000 | Price R-W et al. | |
| 6,075,559 | A | 6/2000 | Harada | |
| 6,081,206 | A | 6/2000 | Kielland | |
| 6,163,278 | A | 12/2000 | Janman | |
| 6,211,912 | B1 | 4/2001 | Shahraray | |
| 6,222,463 | B1 | 4/2001 | Rai | |
| 6,246,337 | B1 | 6/2001 | Rosenberg et al. | |
| 6,249,233 | B1 | 6/2001 | Rosenberg et al. | |
| 6,262,764 | B1 | 7/2001 | Perterson | |
| 6,292,724 | B1 | 9/2001 | Apsell et al. | |
| 6,344,806 | B1 | 2/2002 | Katz | |
| 6,374,240 | B1 | 4/2002 | Walker et al. | |
| 6,384,740 | B1 | 5/2002 | Al-Ahmed | |
| 6,433,706 | B1 * | 8/2002 | Anderson et al. | 340/937 |
| 6,448,889 | B1 | 9/2002 | Hudson | |
| 6,459,386 | B1 | 10/2002 | Jones | |
| 6,570,998 | B1 | 5/2003 | Ohtsuka et al. | |
| 6,628,209 | B1 | 9/2003 | Rother | |
| RE38,626 | E | 10/2004 | Keilland | |
| 6,832,728 | B2 * | 12/2004 | Kennedy | 235/468 |
| 6,842,531 | B2 | 1/2005 | Ohtsuka et al. | |
| 6,868,313 | B2 | 3/2005 | Koljonen | |
| 6,982,654 | B2 | 1/2006 | Rau et al. | |
| 7,119,674 | B2 | 10/2006 | Sefton | |
| 2002/0044607 | A1 | 4/2002 | Koga et al. | |
| 2002/0070881 | A1 | 6/2002 | Marcarelli et al. | |
| 2002/0128769 | A1 | 9/2002 | Der Ghazarian et al. | |
| 2002/0145664 | A1 | 10/2002 | Jones | |
| 2003/0132840 | A1 | 7/2003 | Bahar | |
| 2003/0133594 | A1 | 7/2003 | Sefton | |
| 2004/0218785 | A1 * | 11/2004 | Kim | 382/105 |
| 2005/0073436 | A1 * | 4/2005 | Negreiro | 340/937 |
| 2005/0285721 | A1 | 12/2005 | Bucholz et al. | |
| 2006/0164258 | A1 | 7/2006 | Garibotto et al. | |
| 2006/0171564 | A1 | 8/2006 | Simon | |

FOREIGN PATENT DOCUMENTS

| | | | |
|---|---|---|---|
| DE | 19650756 | A1 | 6/1997 |
| DE | 19608777 | A1 | 9/1997 |
| DE | 10054320 | A1 | 5/2002 |
| DE | 20023009 | U1 | 10/2002 |
| EP | 0040839 | A2 | 12/1981 |
| EP | 0242099 | A2 | 10/1987 |
| EP | 0323326 | A1 | 7/1989 |
| EP | 0367725 | A2 | 5/1990 |
| EP | 0573320 | A1 | 12/1993 |
| EP | 0780273 | A1 | 6/1997 |
| FR | 2226904 | | 11/1974 |
| FR | 2562291 | | 10/1985 |
| FR | 2712105 | | 5/1995 |
| GB | 2239728 | A | 7/1991 |
| GB | 2265243 | A | 9/1993 |
| GB | 2279478 | A | 1/1995 |
| GB | 2284290 | A | 5/1995 |
| GB | 2302608 | A | 1/1997 |
| JP | 7065283 | | 3/1995 |
| JP | 8242442 | | 9/1996 |
| WO | WO-94/07206 | | 3/1994 |
| WO | WO-94/08820 | | 4/1994 |
| WO | WO-94/28516 | | 12/1994 |
| WO | WO-95/11501 | | 4/1995 |
| WO | WO-96/11458 | | 4/1996 |
| WO | WO-97/14116 | | 4/1997 |
| WO | WO-01/99066 | A1 | 12/2001 |

| | | | |
|---|---|---|---|
| WO | WO-02/30144 | A1 | 4/2002 |
| WO | WO-02/075667 | A1 | 9/2002 |
| WO | WO-2004/27730 | A1 | 4/2004 |

OTHER PUBLICATIONS http://www.genetec.com/news/CompanyNewsViewer.aspx?newsId=191, "Genetec acquires controlling interest in AutoVu", Sep. 26, 2005.

"Extreme Unveils New REG-L1 License Plate Capture Camera", Extreme CCTV: Surveillance Systems, brochure, Nov. 4, 2005, Extreme CCTV Inc., Extreme CCTV UK Ltd., Extreme CCTV International Inc.

http://www.extremecctv.com/products/index.cfm?img=117, "REG-L1: DHC-Imaging™ License Plate Capture: REG-L1 PDF Product Sheet", 2 pp., Copyright 2005, Extreme CCTV Surveillance Systems.

"REG-L1 DHC-Imaging™ License Plate Capture (Definitive High-Contrast Imaging™)", Extreme CCTV: Surveillance Systems, brochure, 2 pp., Extreme CCTV Inc.

Buckingham, Simon, "What is General Packet Radio Service?", http://www.gsmworld.com/technology/gprs/intro.shtml, 23 pp., Copyright 2000 Mobile Lifestreams Limited, Berkshire, UK.

"Mobile License Plate Reading For Law Enforcement and Security", brochure, 14 pp., AutoVu Technologies Inc., Montreal, Canada

* cited by examiner

PORTABLE COVERT LICENSE PLATE READER

CROSS-REFERENCE TO RELATED APPLICATION

The present patent application is a formalization of a previously filed, provisional patent application entitled "Portable Covert License Plate Reader," filed on Aug. 5, 2005 as U.S. patent application Ser. No. 60/706,163, by the inventor named in this patent application. This patent application claims the benefit of the filing date of the cited provisional patent application according to the statutes and rules governing provisional patent applications, particularly 35 USC § 119 (e)(1) and 37 CFR §§ 1.78(a)(4) and (a)(5). The specification and drawings of the provisional patent application are specifically incorporated herein by reference.

FIELD OF THE INVENTION

The present invention relates to vehicle monitoring and surveillance systems for law enforcement and, more particularly, to a system for monitoring license plates without detection by passing vehicles.

BACKGROUND OF THE INVENTION

Vehicle license plate monitoring is used in a wide variety of applications including traffic control, controlling access to supervised areas such as parking lots or time limited parking spaces, and identifying stolen vehicles.

License Plate Recognition (LPR) (also referred to as License Plate Reader herein) is an image-processing technology used to identify vehicles by their license plate numbers. As used herein, license plate and license plate number refer generally to the alphanumeric character string normally used on license plates. This technology is used in various security and traffic applications including location of stolen vehicles and access control. LPR technology assumes that all vehicles have their identity displayed externally and that no additional transponder is required to be installed on the car. An LPR system uses illumination, such as infrared and a camera to take the image of the front or rear of the vehicle. Image-processing software then analyzes the images and extracts the plate information. This data is used for enforcement, data collection, and in access control applications.

An LPR system normally contains at least one camera, an illumination source, a frame grabber, computer software and hardware, and a database. The illumination source is a controlled light that can brighten up the license plate, and allow both day and night operation. In most cases, the illumination source is infrared, which is invisible to the driver. The frame grabber is an interface board between the camera and the computer, allowing the software to read the image information. The computer is normally a personal computer or laptop running Windows, Linux, or other suitable operating system. The computer processor executes the LPR application that controls the system, reads the images, analyzes and identifies the plate, and interfaces with other applications and systems. The software includes the LPR application recognition package. The hardware includes various input/output boards that are used to interface to the external world, such as control boards and networking boards. The database stores recorded events and can be a local database or a central database. The data recorded includes the recognition results.

Vehicle license plates can be monitored using portable devices installed in vehicles (e.g., patrol cars); installed overhead on poles or traffic signals; or positioned in proximity to an area to be monitored, such as a highway, parking lot, parking lot entrance, a freeway on/off ramp, etc.

SUMMARY OF THE INVENTION

The present invention is directed to a surveillance system for monitoring vehicle license plates. A portable covert license plate reader is positioned along a roadway in a common, transportable highway traffic control device. The covert license plate reader automatically reads a license plate image for each of a plurality of moving vehicles that passes through the field of view of the camera installed in the reader without detection by moving vehicles. A nearby mobile surveillance unit, such as a patrol car, receives a character string extracted from each recognized license plate image by the reader and compares each received license plate character string in real time with a list of target license plate numbers of interest to law enforcement. If a match is found between the received character string and an entry in the list of target plates, an audible alarm is generated in the mobile surveillance unit and a visual display of the license plate character string is presented to the operator. An operations center communicates with the mobile surveillance unit to receive the license plate images and the recognized character strings and to update the list of target plate numbers stored at the mobile surveillance unit.

In one aspect of the invention, the portable covert license plate reader includes an infrared camera for the imaging of vehicle license plates; an illuminator cooperative with the camera to read images in any operating environment (day or night, fair or inclement weather); and an image acquisition and processing device connected to the camera to acquire images from the camera and to extract the character strings of the detected license plates. The portable license plate reader can also have a lighting control device to define and synchronize infrared emissions from the illuminator with license plate readings; and a wireless communications device (access point) for transmitting captured license plate character strings to the mobile surveillance unit.

In another aspect of the invention, the mobile surveillance unit includes a wireless communications device for receiving captured license plate character strings from each license plate reader; a display device for displaying each received license plate character string; a storage device for storing the list of target plate numbers and the captured license plate character strings from each license plate reader; and an onboard processing unit for comparing each received license plate image with the list of target plate numbers and displaying a license plate character string that matches an entry from the target list.

BRIEF DESCRIPTION OF THE DRAWINGS

These and other advantages and aspects of the present invention will become apparent and more readily appreciated from the following detailed description of the invention taken in conjunction with the accompanying drawings, as follows.

DETAILED DESCRIPTION OF THE INVENTION

The following description of the invention is provided as an enabling teaching of the invention and its best, currently known embodiment. Those skilled in the art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations of the invention are possible and may even be desirable in certain circumstances and are part of the present invention. Thus, the following description is provided as illustrative of the principles of the invention and not in limitation thereof since the scope of the present invention is defined by the claims.

In an exemplary embodiment, the present invention is directed to a portable covert license plate reader (LPR) that can be placed at the side of a road in a traffic channelizer, traffic barrel, or similar object. In an exemplary embodiment of the invention, a transportable fixed camera LPR system can be mounted inside of an ordinary traffic barrel and pointed in a direction to intercept the back license plate images of passing traffic on a roadway. The license plate images taken by the camera are processed to extract the character strings on the plates, which are then transmitted wirelessly to remote mobile surveillance units, such as a police patrol car located in proximity to the portable LPR. The patrol cars have installed a remote host computer for receiving license plate images and data from the portable LPR and processing the received data. This onboard vehicle processing unit compares each received license plate character string with a list of target plate numbers (e.g., stolen plates/cars, Amber alerts, etc.). When the onboard vehicle-processing unit finds a match between a license plate character string from the portable LPR and the list of target plate numbers, an alarm is activated to notify the officer in the patrol car of the match. The onboard vehicle-processing unit exchanges LPR data with a permanent remote operations center that maintains databases of target license plate numbers of interest for law enforcement purposes.

The permanent remote operations center communicates by radio with the remote mobile surveillance units (e.g., patrol cars) by radio and wireless LAN communications to update the list of target plate numbers, and to gather, file and check the reported license plate numbers and to handle patrol-generated alarms.

Figure 1:
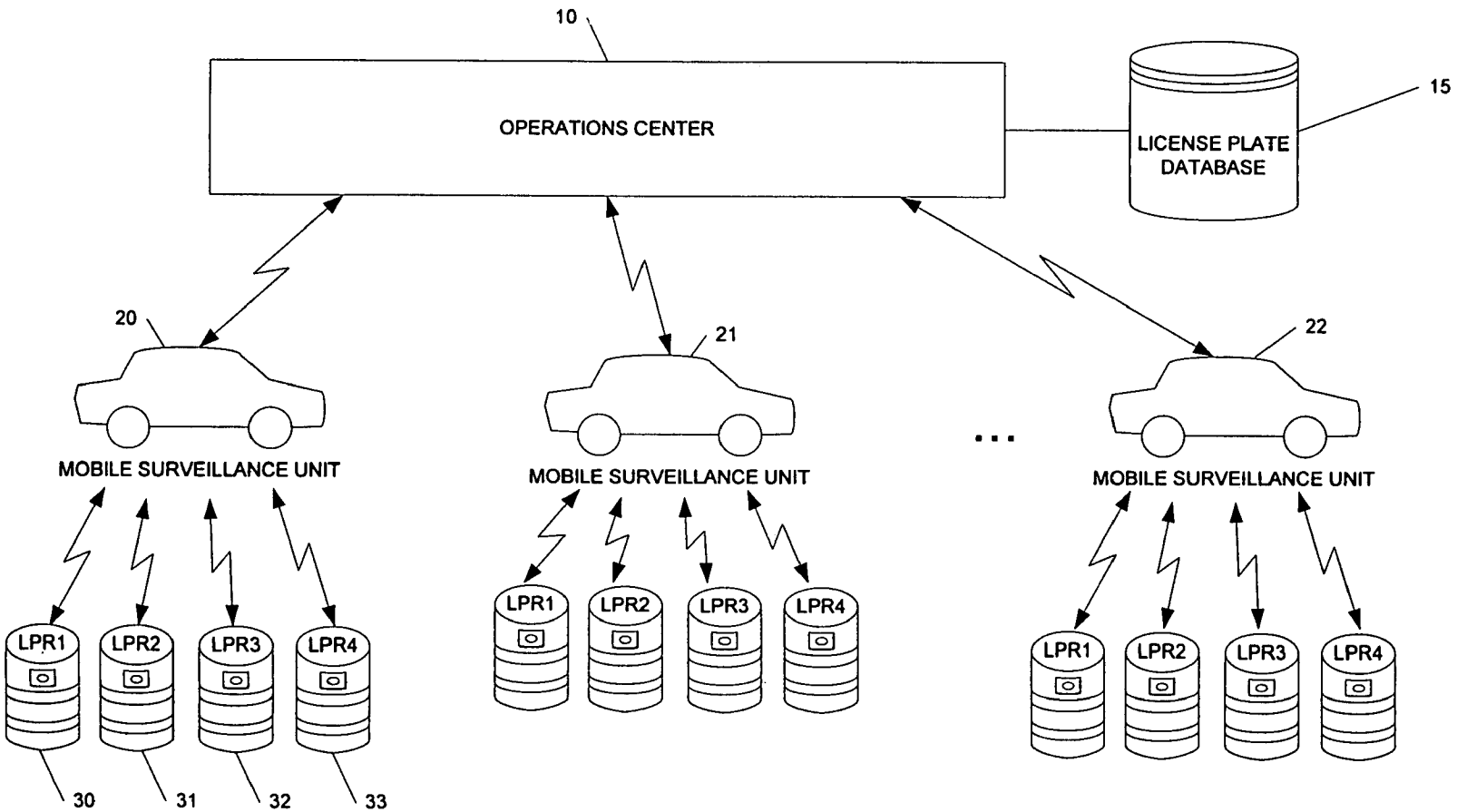
FIG. 1 illustrates a portable covert license plate surveillance system in an exemplary embodiment of the present invention.

FIG. 1 illustrates a portable covert license plate surveillance system in an exemplary embodiment. Portable covert LPRs 30, 31, 32, 33 communicate through a wireless access point with remote mobile surveillance vehicle 20. Other remote mobile surveillance vehicles 21, 22 can also communicate wirelessly with up to four LPRs. The number of license plate readers that each remote surveillance vehicle can communicate with in the exemplary embodiment is by way of example, and not limitation. Each mobile surveillance vehicle 20, 21, 22 can communicate through a wireless access point with remote operations center 10. Operations center 10 includes a license plate number database 15 of target license plate numbers.

Figure 2:
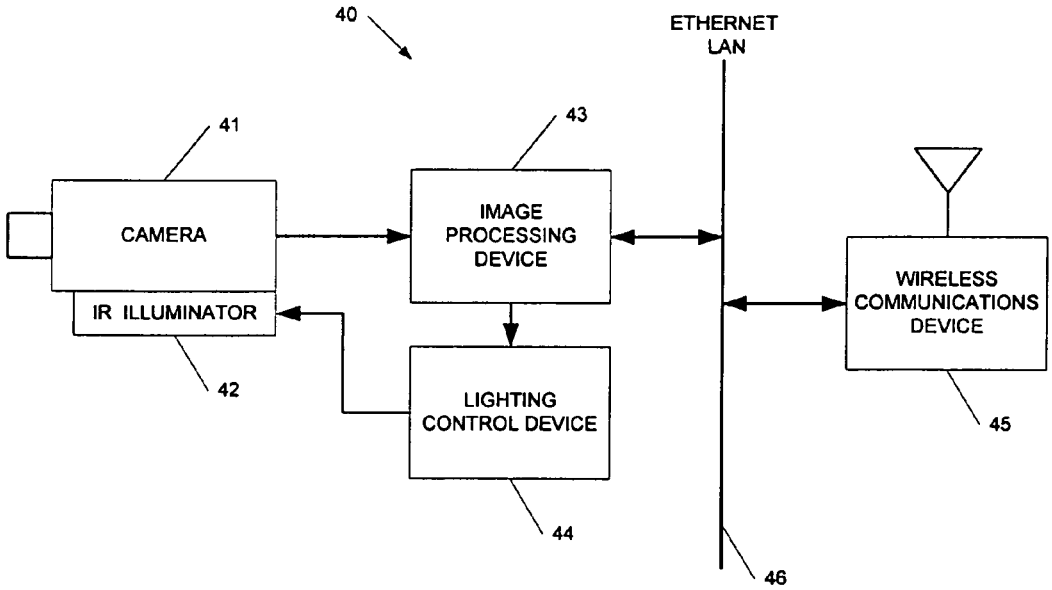
FIG. 2 illustrates an exemplary system architecture of the covert portable license plate reader.

FIG. 2 illustrates an exemplary system architecture of the covert portable license plate reader 40. The portable covert license plate reader 40 can include a progressive scan monochrome (black and white) camera 41 with a C-mount optics interface and a DC power supply. The camera 41 can include a charge-coupled device (CCD). Camera 41 includes a standard gate Auto-Detector smart reader that includes a processor and an Ethernet interface. The camera is sealed in a small enclosure with a processor board and an Ethernet interface in a separate enclosure. There are several commercially-available high performance, low cost processors that are suitable for the portable covert license plate reader.

The progressive area scan camera 41 has the ability to read the image as a whole, rather than as interlaced fields of odd and even lines. Since the progressive camera reads all lines within the same scan, no image blur is visible for fast moving objects as is often the case with line scan cameras due to the time difference between reading the two distinct fields. The optics focal length is estimated to be 12 mm in an exemplary embodiment. The capture range for license plate images should be 3.5 to 8 meters in front of the camera along a lane of the roadway. Image capture is triggered by the presentation of a photoreflective alphanumeric string within the field of view of the camera. Progressive scan cameras utilized can capture up to 25 full frame images per second.

The dedicated illumination source 42 used with the camera is in the near infrared light range concentrated into the capture range. This assures controlled lighting conditions regardless of weather or time of day. An infrared light emitting diode (LED) illuminator 42 emitting beams in the near infrared range is preferable. IR LED illuminator 42 is pulse-operated with very short, controllable duration times and is synchronized with the acquisition system of progressive camera 41. The flash emitted by LED illuminator 42 is synchronous with, and has the same duration as, the aperture opening on progressive camera 41 to ensure maximum efficiency in capturing license plate images.

Image processing device 43 is connected electrically to progressive camera 41 to acquire the images captured by the camera and to extract character strings from reading the license plates. Lighting control device 44 is electrically connected to IR illuminator 42 to time and synchronize IR emissions. Image processing device 43 can be connected to an Ethernet LAN 46 along with wireless communications device 45. The wireless communications device (access point or bridge) 45 transmits license plate number readings to mobile surveillance vehicle 20 for comparison with the list of target plate numbers.

The LPR recognition process has been designed to read the maximum possible number of car plates on the road or during patrol; to check them immediately against the onboard list of target plate numbers, and to generate an alarm message as soon as a plate character string has been found in the onboard target list.

Progressive images can be recorded in a circular input video buffer. The main advantage of this solution with respect to the interlaced video of most other systems is the higher vertical resolution that allows improved recognition performance, even in a wider field of view.

The first image processing step is aimed at detecting the presence of any candidate plate from the continuous video flow. The main goal is to quickly remove from the input video flow, all images that do not contain any plate, in order to avoid any further operations on these images and to achieve a higher processing speed for actual plate images. When a candidate plate is detected, the result of processing the input image is definition of a region of interest that contains all of the relevant image features, i.e., discontinuities that may be indications of a plate's presence. The same region of interest is further processed to correct the rotation of the plate in the image and to achieve an almost horizontal orientation of the plate characters. A morphological filter can be used to improve the quality of the plate image and to remove external artifacts like the frame of the plate. The output of this process is a normalized, enhanced region of interest image with horizontal orientation of the plate.

The normalized region of interest can be processed further with a two-dimensional digital filter for contrast and edge enhancement to allow the identification and separation of each individual character with respect to the background of the plate. The result of this processing step is a sequence of rectangular boxes (segments) that contain all candidate characters and that may be aligned on a single line or multiple lines, if necessary.

The next step in the character recognition process is the measurement of each candidate's segment with respect to the "models" that have been acquired during a learning phase. This measurement process is based on a statistical technique of feature matching; all characters are described as a sequence of image features and a normalized distance is computed between each character sample (current segment) and the stored feature models acquired from examples during the learning phase. This distance achieves a minimum value when the most similar character is found in the list of models.

The contextual analysis process then exploits both spatial and syntactic information in order to select the best hypothesis for the number plate. If the image being processed contains N validated characters on a number plate containing K characters, the general idea is to extract all choices of K elements from N and to evaluate them both spatially and syntactically.

Syntactic constraints are also included by checking the systems of the allowed alphabetic and numeric distances in each position of a number plate. The sum of such distances, normalized by the number of characters, is taken as an estimate of the syntactic plausibility of a given hypothesis. It is also possible to include additional constraints about plate size and character spacing. Finally, all complete hypotheses are ranked according to their total cost (syntactic cost) and the best one is retained for temporal post-processing.

The final temporal post-processing stage aims to extract a single number plate for each detected vehicle. This identification is obtained by tracking all recognized characters along the consecutive video frames. All number plate hypotheses that satisfy such tracking process are merged together if they are syntactically similar and are spatially coherent with the assumed vehicle trajectory in the image plane. The result of this temporal integration is an improved accuracy of the recognized plate and the possibility of recovering some character that may appear and disappear in the image during the transit of the plate (e.g., when the plate enters or exits the image frame). The temporal integration is run independently for all plate hypotheses so that multiple transit plates can be tracked and recognized simultaneously.

Figure 3:
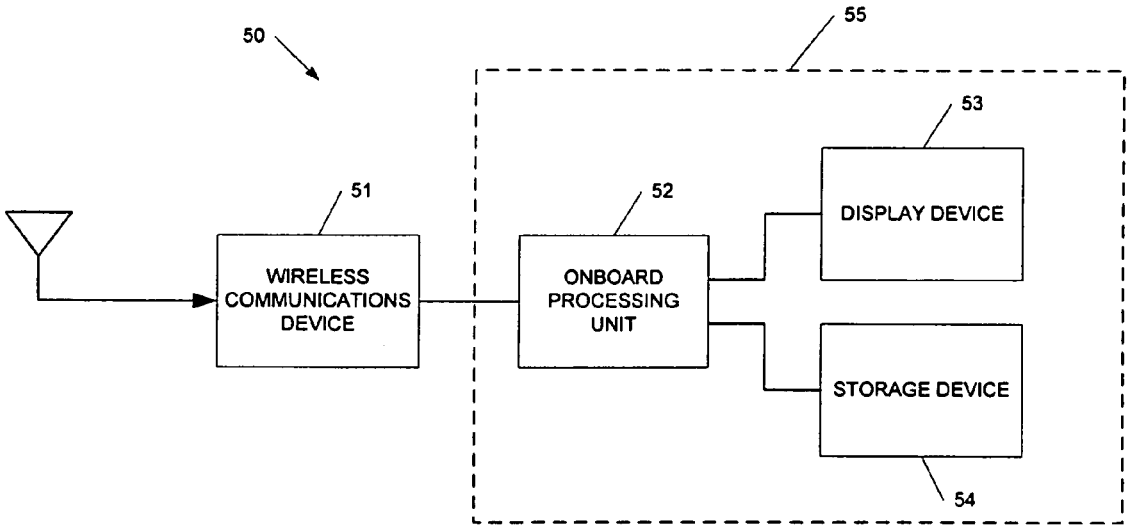
FIG. 3 illustrates an exemplary system architecture of the mobile surveillance system.

FIG. 3 illustrates an exemplary system architecture of the mobile surveillance system 50. Wireless communications device 51 receives the license plate readings from up to four covert LPRs, covering up to four lanes of roadway. The number of covert LPRs is exemplary and non-limiting. Onboard processing unit 52 processes the license plate character strings, compares the license plate character strings with the list of target plate numbers stored in storage device 54, activates an audible alarm, and generates a visual display of the license plate numbers on display device 53 when a match is determined.

The remote host computer 55 installed in the remote mobile surveillance vehicle 20 can be a Windows XP/2000 Car PC, a mobile data terminal (MDT) or a standard laptop. The remote host 55 connects wirelessly to the portable covert LPR via the wireless 802.11b/g standard provided by the access point 51. The remote host computer 55 includes an onboard vehicle-processing unit 52, a display device 53 and a storage device 54 for storing captured license plate data from the LPRs and a list of target plate numbers. The software user interface provides the following functionality:

(1) real-time images and reads of each captured license plate from the covert LPR;
(2) comparison of each license plate read with the list of target plates;
(3) an audible and visual alarm in the event of a successful match of a license plate number read with the target list;
(4) means to import a target list file from an external memory device, e.g., a USB memory stick;
(5) target list management functions such as license plate insertion, search and deletion;
(6) live image feed from the LPR camera, including an option to superimpose a marker onto the center of the image to assist camera alignment;
(7) management of up to four LPR cameras simultaneously, thereby enabling an officer to check four lanes of the roadway; and
(8) counters for the total reads of all connected LPR cameras.

In addition to the aforementioned features, the software user interface can optionally provide a list of recently captured license plate numbers. Each license plate read is presented with the plate string, the time of capture and the identifier for the LPR camera that generated the read.

The software user interface supports two modes of operation: collection mode and alarm mode. At the end of each patrol car shift, every read and alarm can be uploaded to the permanent remote operations center 10. The operations center 10 can provide data mining features for all connected LPR cameras as well as for each remote mobile surveillance vehicle.

Figure 4A:
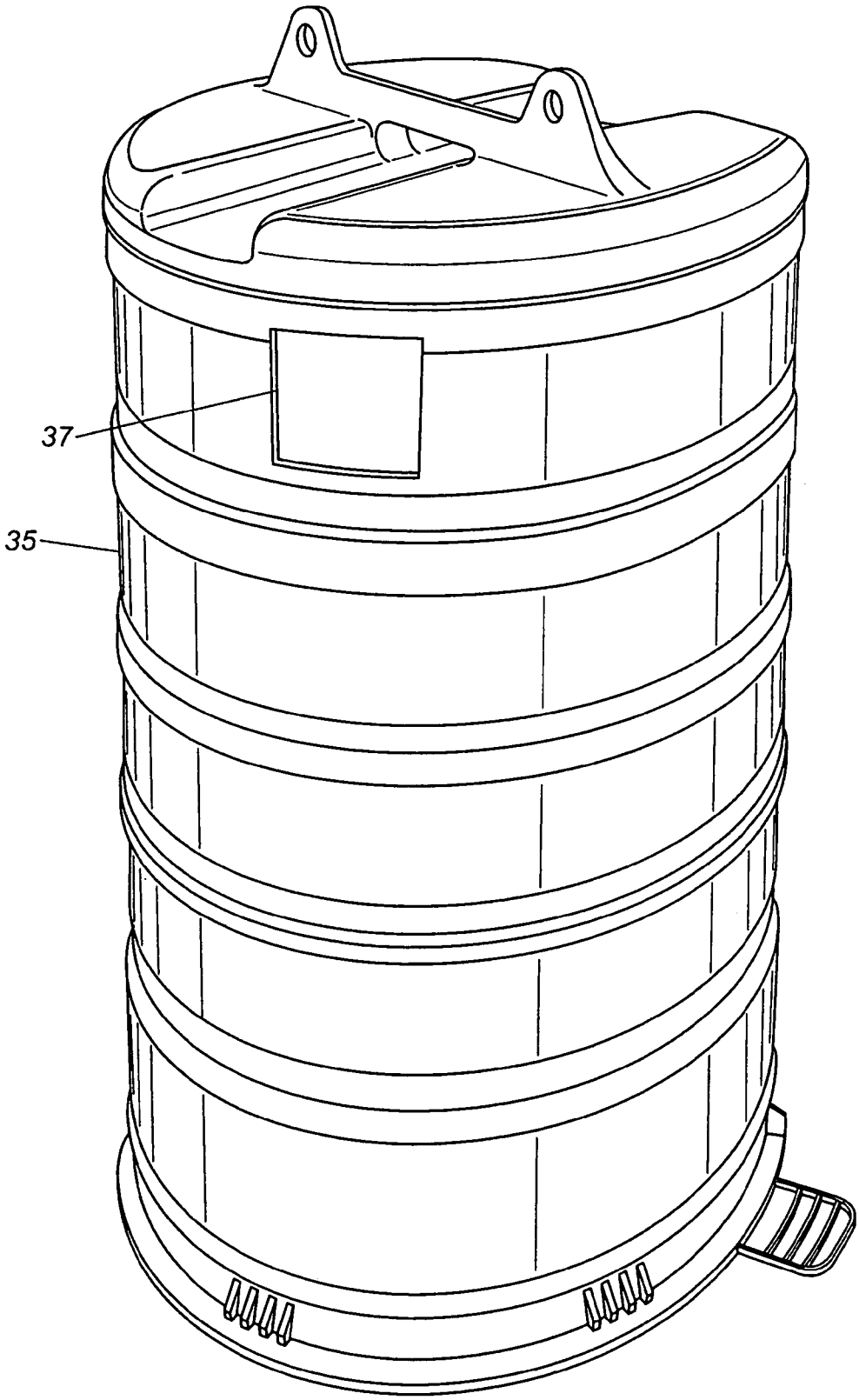
FIG. 4A shows a traffic channelizer in which the license plate reader can be deployed.
Figure 4B:
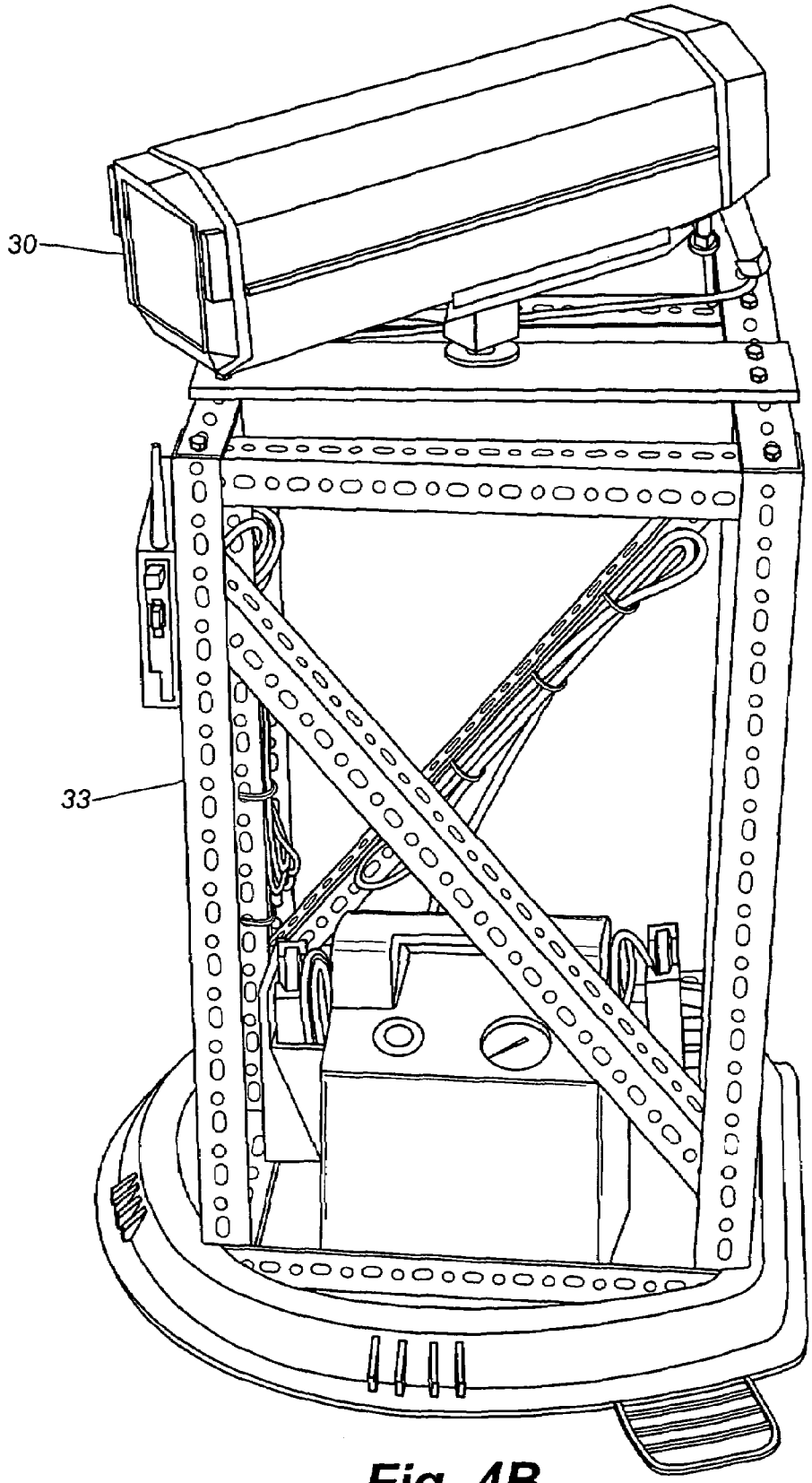
FIG. 4B shows an exemplary embodiment of the license plate reader attached to an aluminum mount in an operational configuration.
Figure 4C:
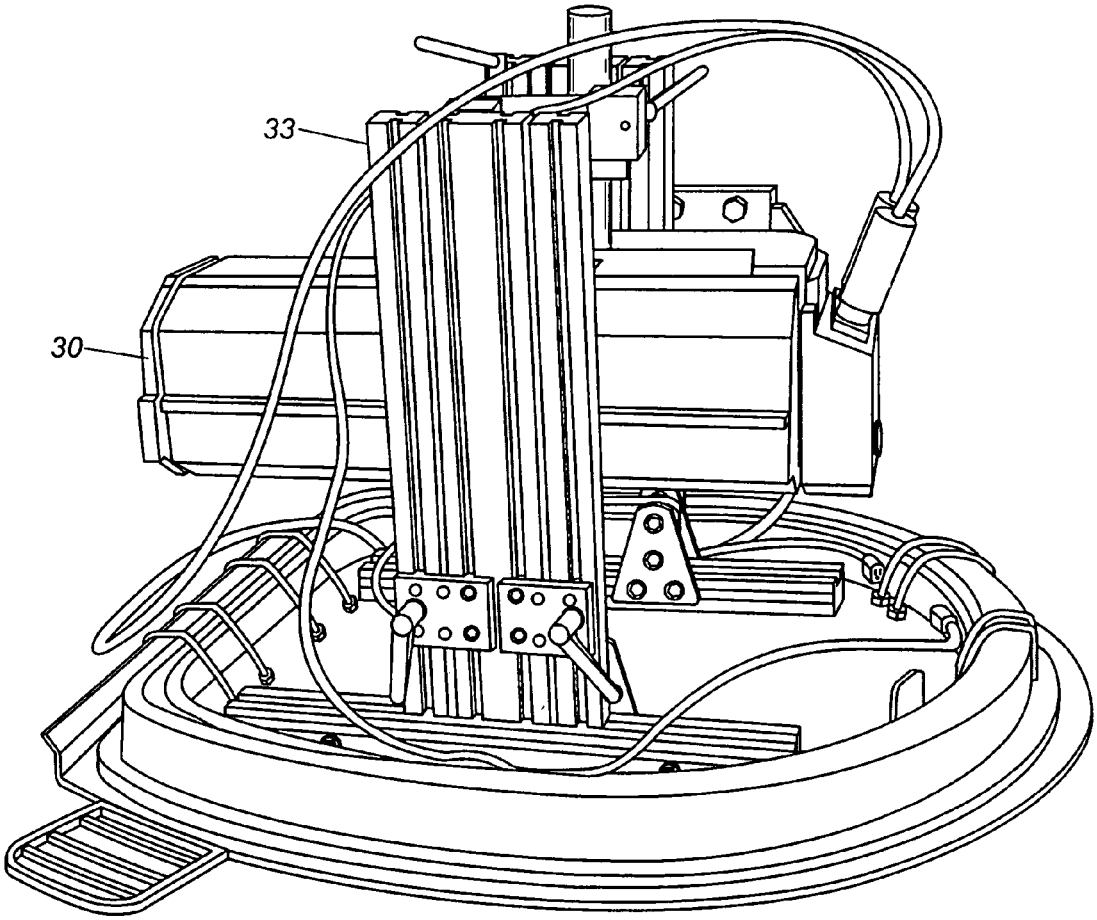
FIG. 4C shows an exemplary embodiment of the license plate reader in a closed, transportable configuration with the aluminum mount folded.

FIG. 4A depicts the license plate reader 30 of the invention deployed in a traffic channelizer 35 in which the LPR 30 can be placed. When installed inside the traffic channelizer 35, the lens of the camera is flush with the opening 37 in the channelizer to avoid detection by passing vehicles. The portable covert LPR assembly includes a collapsible aluminum frame for transport. FIG. 4B depicts the LPR 30 in an operational configuration. FIG. 4C depicts the LPR 30 in a closed, transportable configuration with the aluminum mount folded as shown. The LPR uses fast rechargeable sealed batteries to supply power (24 V) to the camera and other electrical components such as a processor and wireless LAN access point. A Cisco Aironet 350 Series access point or an equivalent is suitable for the present invention.

Figure 5:
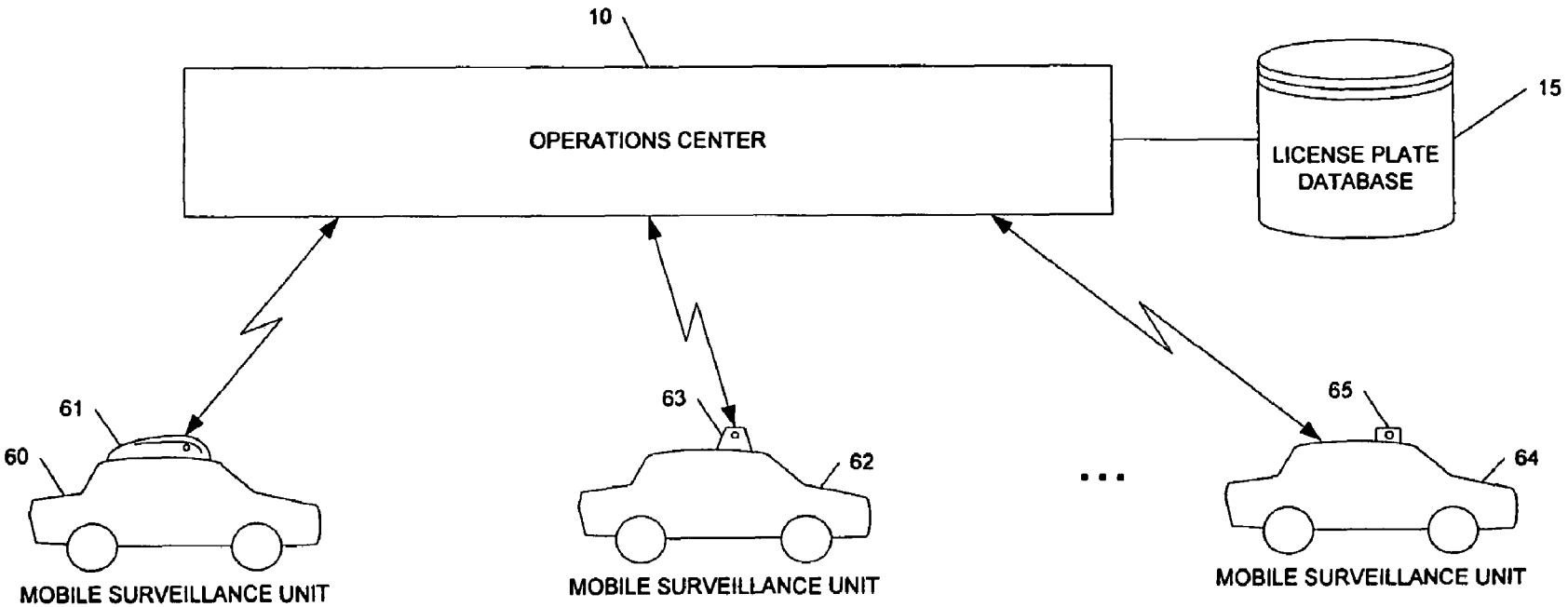
FIG. 5 illustrates a mobile covert license plate surveillance system in an exemplary embodiment of the present invention.

FIG. 5 illustrates a mobile covert license plate surveillance system in another exemplary embodiment of the invention in which the mobile surveillance units 60, 62, 64 are self-contained image processing systems. Covert is used in its ordinary and customary meaning of hidden, i.e., not openly shown. As in the embodiment having a plurality of portable covert LPRs, the mobile surveillance units communicate wirelessly with remote operations center 10 and the license plate number database 15 of target license plates.

Figure 7A:
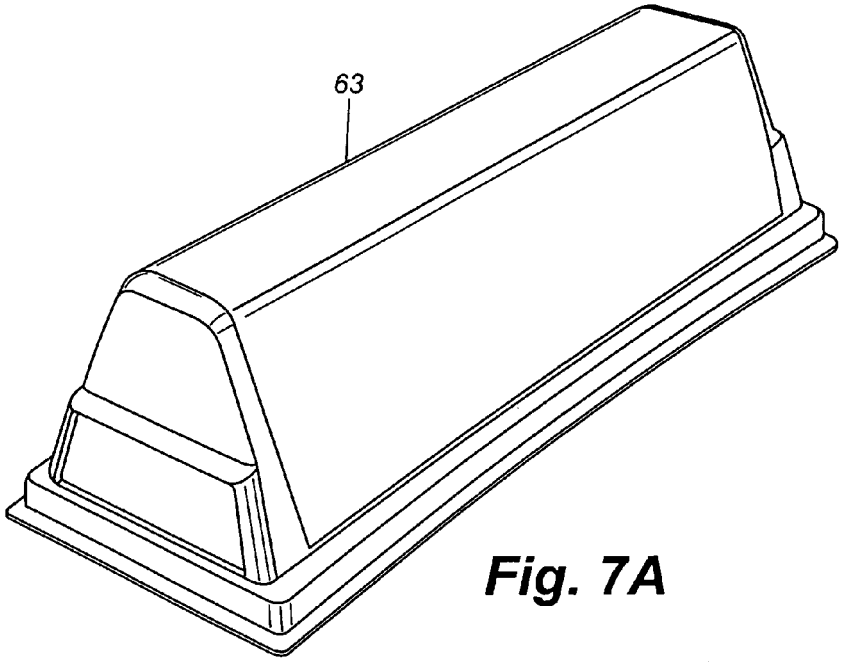
FIGS. 7A and 7B illustrate an exemplary taxi sign and a two-camera LPR for deployment inside the taxi sign.
Figure 7B:
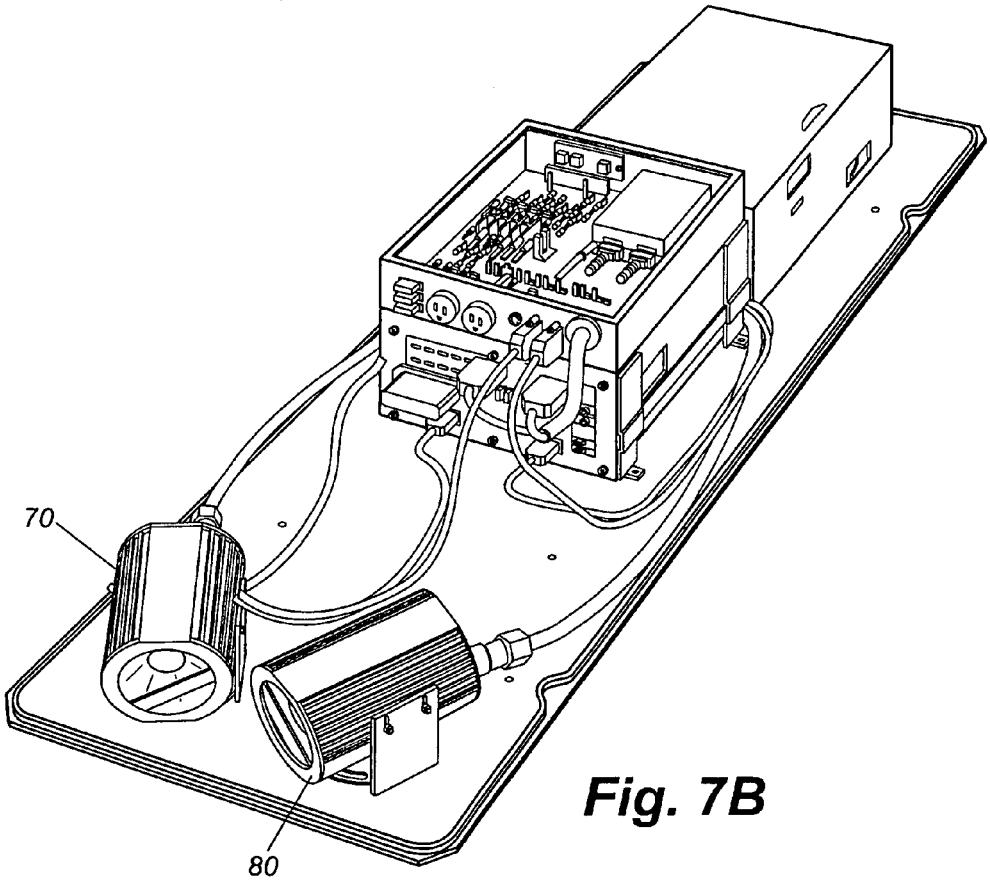

A binocular reading head containing two digital cameras can be used in an exemplary embodiment. The digital cameras are oriented in such a way as to frame both lanes around the patrol car, on the left and right side of the driving direction. This reading head can be installed very easily on top of a mobile surveillance vehicle, either in a fixed or in a removable configuration. For example, the camera can be fixed on the existing light bar 65 of a patrol car 64, or can be added to the roof through a magnetic support. Monocular split sensors also can be installed on the roof of the car and oriented in such a way as to frame both lanes on the side of the car. It is also possible to orient the sensor in the front or rear directions according to the different application requirements. The covert LPR can be installed in a luggage carrier 61 on a mobile surveillance vehicle 60, which can be a car or a sports utility vehicle. Exemplary luggage carriers that can be used include those manufactured by Thule, Inc. or Yakima. The covert LPR can be installed inside a "taxi" sign 63 on a mobile surveillance vehicle 62. FIGS. 7A-7B depict an exemplary taxi sign in which a two camera LPR can be deployed. The covert LPR can also be installed on a toolbox on a flat bed of a truck.

A miniaturized digital camera is combined with a pulsed infrared LED illuminator that is synchronized with the camera aperture. There are alternatives that may be used for the LED illuminator. One alternative is to use a visible near-infrared LED light source. Using a short wavelength pulse, the illumination source appears as a flashing red light. A second alternative is a non-visible infrared LED light. In this case, a longer wavelength pulse is used and is effective when there is sufficient contrast between the plate characters and the plate background (typically with dark characters on a white or clear background).

The onboard processing system is implemented to read the maximum possible number of car plates on the road during patrol, both parked and in motion, and to check them immediately against a target list database that is installed onboard the vehicle and generates an alarm message as soon as a plate-string has been found in the same target list. When an alarm message is generated, a transit image and a zoom of the plate can be displayed to the patrol officer.

The human computer interface installed on the onboard PC provides target list operations, alarm operations, and data collection. The target list operations that can be performed by the officer during the patrol can include inserting a temporary license plate number in the target list, deleting a temporary license plate number in the target list, and searching for a license plate number in the target list. If a license plate number read by the LPR is present in the target list, it is stored as an alarm and the following information can be displayed in the patrol vehicle: gray scale image; license plate number; time and date of capture; a note explaining the reason for the presence of the license plate in the target list; and a camera identifier. An audible alarm is generated by the onboard PC to alert the officer of an alarm. The LPR continuously reads the license plate numbers of all the vehicles present in the field of view of the two onboard cameras. All transits read during a patrol are stored in the onboard PC and downloaded to the operations center station at the end of the patrol.

The LPR mobile system architectural scheme combines both a stationary subsystem (i.e., operations center), and a mobile component installed onboard the patrol cars. The LPR mobile system receives updated target lists, typically just before the patrol begins. The patrol car can upload the target list via a wireless local area network (LAN). Once the target list is uploaded, the car starts a new patrol. At the end of the patrol, the same wireless LAN connection is used to download patrol data to the operation center.

The operations center is installed in a PC environment, with a client/server architecture for target list management, investigation services, license plate number searches and database management. The system is "scalable" in the sense that it may span from a geographically wide installation with a central headquarters and the coordination of a large number of patrol cars, up to a fully autonomous individual peripheral system, where all such supervisory functions can be installed in the same automotive PC, onboard the patrol vehicle. From a hardware perspective, the operations center can include a series of PC server platforms for data downloading and database management with a suitable number of client platforms for the supervisory operations, or it may collapse into a single, onboard automotive platform. The operations center enables the following main operations: target list management (insertion, updating); a query search through all collected data (vehicle transits, alarms, etc.) using different search keys such as date and time interval, geographical position, etc.; and communication with the onboard system as well as with external coordination centers.

Figure 6:
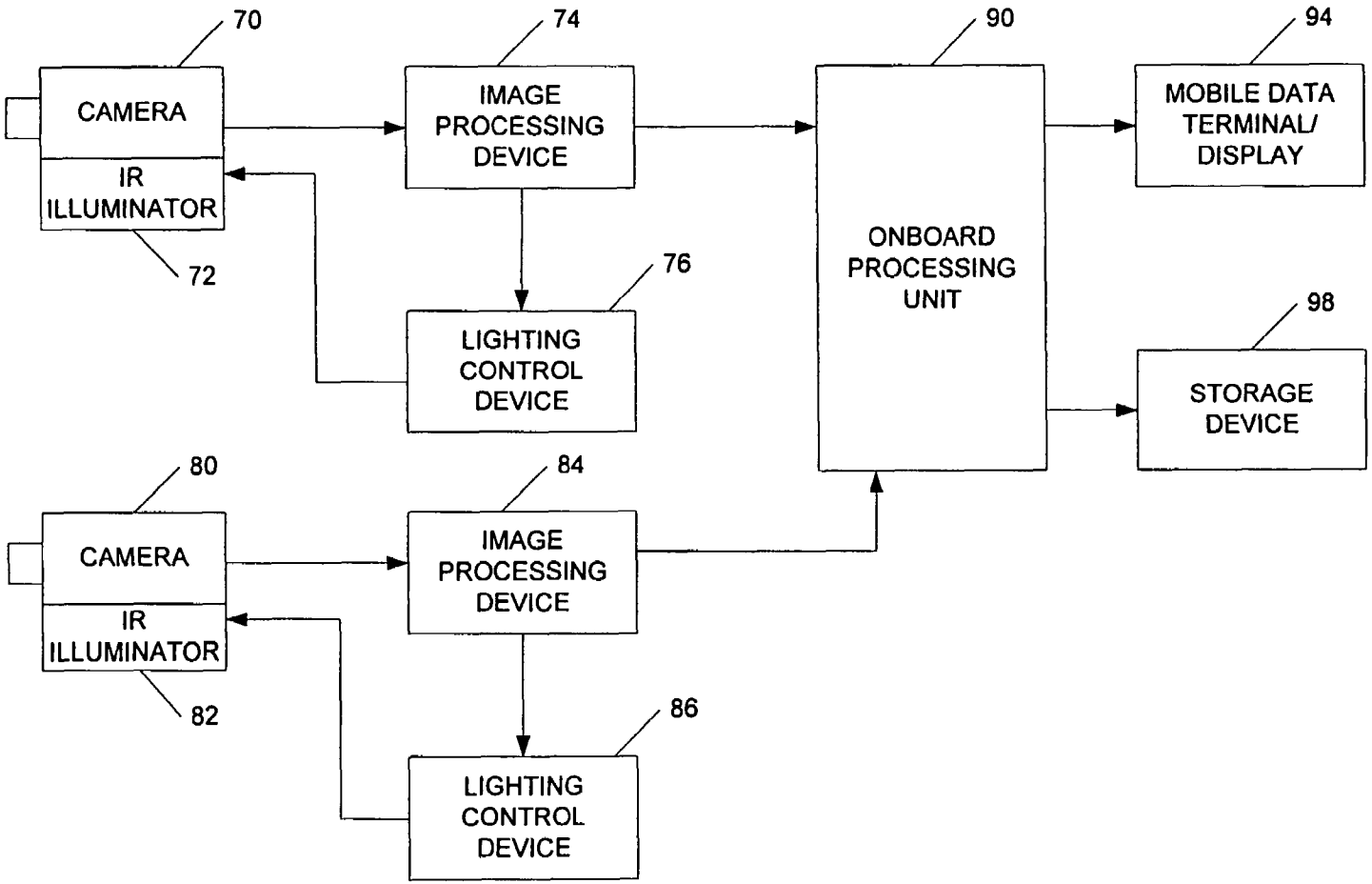
FIG. 6 illustrates an exemplary system architecture of the mobile covert license plate surveillance system.

FIG. 6 illustrates an exemplary system architecture of the mobile covert license plate surveillance system. The mobile covert license plate surveillance system can include a pair of progressive scan monochrome cameras 70, 80. A dedicated illumination source 72, 82 is used with each camera 70, 80 and provides infrared (non-visible) light concentrated into the capture range to control lighting conditions regardless of weather or time of day. The infrared light emitting diode (LED) illuminators 72, 82 emit beams in the near infrared range. IR LED illuminators 72, 82 are pulse-operated with very short, programmable exposure times and are synchronized with the acquisition system of progressive scan cameras 70, 80, respectively. The flashes emitted by LED illuminators 72, 82 are synchronous with, and have the same duration as, the aperture openings on progressive cameras 70, 80 to ensure maximum efficiency in capturing license plates.

Image processing devices 74, 84 are connected electrically to progressive cameras 70, 80 to acquire the images captured by the cameras and to extract character strings from reading the license plates. Lighting control devices 76, 86 are electrically connected to IR illuminators 72, 82 to time and to synchronize IR emissions. Image processing devices 74, 84 and lighting control devices 76, 86 are connected to an onboard processing unit 90. The onboard processing unit 90 processes the license plate images and compares the license plate images with the list of target plate numbers stored in storage device 98. An audible alarm, and a visual display of the license plate number are generated by the onboard mobile data terminal 94 when a match is determined.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiment are possible without departing from the spirit and scope of the present invention. In addition, it is possible to use some of the features of the present invention without the corresponding use of the other features. Accordingly, the foregoing description of the exemplary embodiment is provided for the purpose of illustrating the principles of the present invention and not in limitation thereof since the scope of the present invention is defined solely by the appended claims.

The invention claimed is:

1. A surveillance system for monitoring a plurality of vehicle license plates comprising:

a portable license plate reader including a camera for automatically imaging a license plate and extracting a character string from the image for each of a plurality of moving vehicles that pass through a field of view of the camera without detection by the moving vehicles;

a mobile surveillance unit positioned in proximity to the license plate reader for receiving the extracted character string from the reader, comparing each extracted character string with a list of target plate numbers, and generating an audible alarm and a visual display when a match is found; and an operations center for communicating with the mobile surveillance unit to receive each extracted character string from the mobile surveillance unit and to update the list of target plate numbers stored at the mobile surveillance unit.

2. The surveillance system for monitoring vehicle license plates of claim 1 wherein the portable license plate reader comprises:

a camera for imaging of vehicle license plates;

an illuminator cooperative with the camera to provide illumination of the vehicle license plates; and an image acquisition and processing device coupled to the camera to acquire images of the vehicle license plates from the camera and to extract character strings of each detected license plate.

3. The surveillance system for monitoring vehicle license plates of claim 2 wherein the portable license plate reader further comprises a lighting control device to time and synchronize infrared emissions from the illuminator with each license plate imaging.

4. The surveillance system for monitoring vehicle license plates of claim 2 wherein the portable license plate reader further comprises a wireless communications device for transmitting extracted license plate character strings to the mobile surveillance unit.

5. The surveillance system for monitoring vehicle license plates of claim 1 wherein the mobile surveillance unit comprises:

a wireless communications device for receiving extracted license plate character strings from each license plate reader;

a display device for displaying each received license plate character string;

a storage device for storing the list of target plate numbers and the captured license plate character strings from each license plate reader; and an onboard processing unit for comparing each received license plate character string with the list of target plate numbers and displaying each license plate character string that matches an entry from the target list.

6. The surveillance system for monitoring vehicle license plates of claim 1 wherein the portable license plate reader is mounted in a transportable structure positioned adjacent to a roadway.

7. The surveillance system for monitoring vehicle license plates of claim 6 wherein the transportable structure is a traffic channelizer or a traffic barrel.

8. A surveillance system for monitoring a plurality of vehicle license plates comprising:

a license plate reader, mounted in a transportable traffic channelizer device, including a camera for automatically imaging a license plate and extracting a character string from the image for each of a plurality of moving vehicles that pass through a field of view of the camera in the reader without detection by the moving vehicles;

a processing unit for receiving each character string extracted by the reader and comparing each received character string with a list of target plate numbers; and a display device for displaying each license plate character string that matches an entry from the target list.

9. The surveillance system for monitoring a plurality of vehicle license plates of claim 8 wherein the processing unit generates an audible alarm and a visual display on the display device when a match is found.

10. The surveillance system for monitoring a plurality of vehicle license plates of claim 8 wherein the license plate reader comprises:

an illuminator cooperative with the camera to provide illumination of the license plate; and an image processing device coupled to the camera to acquire images from the camera and to extract the character string of the license plate.

11. The surveillance system for monitoring a plurality of vehicle license plates of claim 8 wherein the license plate reader further comprises a lighting control device to synchronize an infrared emission from the illuminator with the license plate imaging.

12. The surveillance system for monitoring a plurality of vehicle license plates of claim 8 further comprising a storage device for storing the character string and the list of target plate numbers.

13. The surveillance system for monitoring vehicle license plates of claim 8 wherein the transportable traffic channelizer device comprises a traffic channelizer or a traffic barrel.

* * * * *